United States Patent [19]

Korenberg

[11] Patent Number: 4,974,531

[45] Date of Patent: Dec. 4, 1990

[54] METHOD AND APPARATUS FOR INCINERATING HAZARDOUS WASTE

[75] Inventor: Jacob Korenberg, York, Pa.

[73] Assignee: Donlee Technologies, Inc., York, Pa.

[21] Appl. No.: 526,701

[22] Filed: May 22, 1990

[51] Int. Cl.[5] ..... F23D 14/00; F23G 5/00

[52] U.S. Cl. ..... 110/346; 110/245; 110/222

[58] Field of Search ..... 110/245, 222, 248, 346

[56] References Cited

U.S. PATENT DOCUMENTS

| | | | |
|---|---|---|---|
| 3,888,193 | 6/1975 | Kishigami et al. . | |
| 3,922,975 | 12/1975 | Reese . | |
| 4,419,965 | 12/1983 | Garcia-Mallol et al. . | |
| 4,421,036 | 12/1983 | Brannstrom et al. . | |
| 4,430,950 | 2/1984 | Foresto . | |
| 4,505,209 | 3/1985 | Strohmeyer, Jr. . | |
| 4,548,138 | 10/1985 | Korenberg | 110/245 |
| 4,708,067 | 11/1987 | Narisoko et al. . | |
| 4,724,776 | 2/1988 | Foresto . | |
| 4,753,177 | 6/1988 | Engstrom et al. | 110/245 |
| 4,753,177 | 6/1988 | Engstrom et al. . | |
| 4,757,771 | 7/1988 | Narisoko et al. | 110/346 |
| 4,817,563 | 4/1989 | Beisswenger et al. | 110/245 |
| 4,864,944 | 9/1989 | Engstrom et al. | 110/245 |

OTHER PUBLICATIONS

Untitled Article Appearing on pp. 55–58 of the Apr. 1988 Mechanical Engineering Magazine.

Article Entitled "Opportunity Knocks in Biomedical Wastes:" Appeared in the Jan. 1988 Edition of Waste Age Magazine.

Article Entitled "Optimal Performance of Hospital Incinerators" which was Presented at a Symposium in Sep. 1988.

1987 Article Entitled "Incineration of Hazardous Waste, A Critical Review".

*Primary Examiner*—Henry C. Yuen

*Attorney, Agent, or Firm*—Finnegan, Henderson, Farabow, Garrett & Dunner

[57] ABSTRACT

An incineration apparatus and method for disposal of infectious hazardous waste including a fluidized bed reactor containing a bed of granular material. The reactor includes a first chamber, a second chamber, and a vertical partition separating the first and second chambers. A pressurized stream of air is supplied to the reactor at a sufficient velocity to fluidize the granular material in both the first and second chambers. Waste materials to be incinerated are fed into the first chamber of the fluidized bed, the fine waste materials being initially incinerated in the first chamber and subsequently circulated over the partition to the second chamber wherein further incineration occurs. Coarse waste materials are removed from the first chamber, comminuted, and recirculated to the second chamber for further incineration. Any partially incinerated waste materials and ash from the bottom of the second chamber are removed and recirculated to the second chamber for further incineration. This process is repeated until all infectious hazardous waste has been completely incinerated.

13 Claims, 1 Drawing Sheet

METHOD AND APPARATUS FOR INCINERATING HAZARDOUS WASTE

BACKGROUND OF THE INVENTION

1. Field of the Invention

The present invention relates to an apparatus and method for incinerating hazardous waste, and more particularly to an apparatus and method for incinerating infectious hazardous waste such as hospital waste.

2. Description of the Related Art

Infectious waste can be defined as that waste which, unless processed, disposed, stored, collected or transported with caution, is or may be contaminated by a disease-producing microorganism or may harm or threaten human health. The term infectious waste includes, among others, the following types of waste: waste generated by hospitalized patients who are isolated, or on blood and body fluid precautions, in order to protect others from their communicable disease; cultures and stocks of etiologic agents; animal waste blood and animal blood products which are known or suspected to contain contagious zoonotic pathogens, and human waste blood and blood products; tissues, organs, body parts, blood, and body fluids that are removed during surgery and autopsies; wastes that were in contact with pathogens in any type of laboratory work; carcasses and body parts of animals exposed to contagious zoonotic pathogens; waste biologicals, for example vaccines, produced by pharmaceutical companies for human or veterinary use; and food and other products or equipment that are discarded because of contamination with etiologic agents.

Many of the above types of infectious waste are generated at hospital sites. Hospitals are currently experiencing much difficulty in properly disposing of this waste. This is, in part, because the waste generated at hospital sites includes a variety of constituents having different moisture contents and densities. The varied characteristics of waste generated by a hospital complicates the disposal process, including the handling of ash generated by incineration of the waste. Thus, there is a particular need for an apparatus and method of disposing of such infectious hospital waste.

Traditional disposal technology such as landfill and incineration have been suggested as alternatives for disposing of infectious waste. However, traditional technology has shortcomings which prohibit its use in disposing of infectious waste such as that found at hospitals. For instance, the number of available landfills that can handle such waste materials is decreasing each year. Also, traditional incineration does not allow for sufficient residence time to ensure that all infectious waste has been fully incinerated. Moreover, traditional incinerators encounter difficulty maintaining stable combustion of hospital waste because of its non-uniform nature.

Accordingly, it is an object of the present invention to provide an incineration apparatus that can maintain a stable temperature while incinerating waste of a non-uniform nature.

It is another object of the present invention to provide an apparatus for incinerating infectious hospital waste that will provide sufficient residence time for complete incineration.

Still another object of the present invention is to provide a cost-effective and reliable apparatus and method to dispose of hazardous waste.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the invention as embodied and broadly described herein, there is provided a method of incinerating hazardous waste that includes providing a fluidized bed reactor containing a bed of granular material. The reactor includes a first chamber and second chamber separated by a partition. A stream of pressurized air is supplied to the reactor at a sufficient velocity to fluidize the granular material in both the first and second chambers. Waste material to be incinerated is fed into the first chamber of the fluidized bed reactor, the fine waste materials being initially incinerated in the first chamber and subsequently circulated over the partition to the second chamber wherein further incineration occurs. Coarse waste materials are removed from the first chamber and comminuted. The comminuted waste materials are recirculated to the second chamber for further incineration. Partially incinerated waste and ash from the bottom of the second chamber is removed and recirculated to the second chamber for further incineration.

In another aspect of the present invention, an apparatus for incinerating hazardous waste is provided. The apparatus includes a fluidized bed reactor containing a bed of granular material. The reactor includes a first chamber, a second chamber, and vertical partition separating the first and second chambers. The reactor also includes a plurality of openings. A means is provided for supplying a pressurized stream of air to the reactor at a sufficient velocity to fluidize the granular material in both the first and second chambers. A means is provided for feeding waste materials to be incinerated into the first chamber of the fluidized bed, the fine waste materials being initially incinerated in the first chamber and subsequently circulated over the partition to the second chamber wherein further incineration occurs. A means is provided for removing the coarse waste materials from the first chamber and for comminuting the coarse waste material removed from the first chamber. The apparatus includes means for recirculating the comminuted waste material to the second chamber for further incineration. A means for removing partially incinerated waste and ash from the bottom of the second chamber is provided. Also a means is provided for recirculating the materials removed from the second chamber back to the second chamber for further incineration.

BRIEF DESCRIPTION OF THE DRAWING

The accompanying drawing, which is incorporated in and constitutes a part of the specification, illustrates a preferred embodiment of the invention and, together with the general description provided above and the detailed description of the preferred embodiment provided below, serves to explain the principles of the invention.

DESCRIPTION OF THE PREFERRED EMBODIMENT

Figure 1:
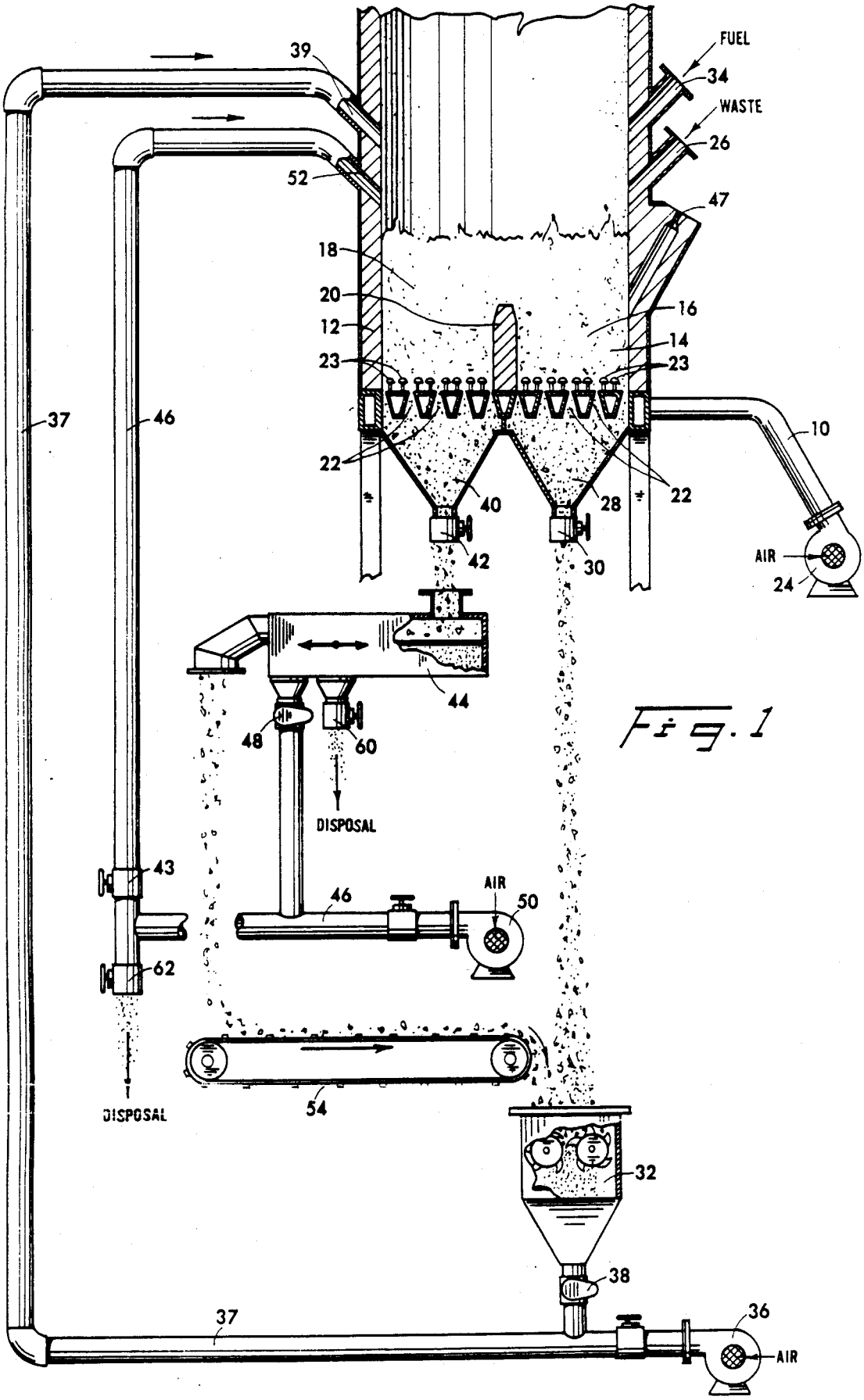
FIG. 1 is a partially pictorial and partially schematic illustration of an apparatus incorporating the teachings of the present invention.

Reference will now be made in detail to the present preferred embodiment of the invention as illustrated in FIG. 1. The apparatus shown in FIG. 1 is designated generally by the reference numeral 10. Such an apparatus recirculates infectious waste as many times as necessary to allow for complete incineration and disinfection.

In accordance with the present invention, the incineration apparatus includes a fluidized bed reactor containing a bed of granular material. The reactor includes a first chamber, a second chamber, and a vertical partition separating the first and second chambers. The reactor further includes a plurality of openings. As embodied herein, incineration apparatus 10 includes fluidized bed reactor 12 containing a bed of granular material 14. The granular material can be ordinary sand or ash if coal is the primary fuel. Reactor 12 includes a first chamber 16, a second chamber 18, and a vertical partition 20 separating first chamber 16 and second chamber 18. Partition 20 does not extend upwardly the full height of the fluidized bed. Rather, partition 20 extends upwardly to a sufficient height to prevent coarse materials from entering second combustion chamber 18 and to ensure an adequate residence time in first chamber 16 for fine waste particles. Reactor 12 further includes a plurality of openings 22 and air nozzles 23 in the bottom of chambers 16 and 18. The percentage of incineration occurring in first chamber 16 and second chamber 18 is expected to be substantially proportional to the air distribution between the chambers.

In accordance with the present invention, the incineration apparatus includes means for supplying a pressurized stream of air to the reactor at a sufficient velocity to fluidize the granular material in both the first and second chambers. As embodied herein, the pressurized stream of air is supplied by blower 24 to reactor 12 through air nozzles 23 at a sufficient velocity to fluidize the granular material in first chamber 16 and second chamber 18. In the embodiment shown in FIG. 1, a single blower 24 fluidizes the granular material in both first chamber 16 and second chamber 18. It is contemplated that separate blowers may be utilized to fluidize the granular material in each chamber.

In the embodiment shown in FIG. 1, the stream of pressurized air supplied to reactor 12 creates a bubbling fluidized bed. It is also contemplated that the stream of pressurized air supplied to the reactor may create a circulating fluidized bed.

In accordance with the present invention, the incineration apparatus includes means for feeding fuel to the reactor. As embodied herein, once reactor 12 is rendered operational by start-up burner 47, fuel is supplied to reactor 12 through fuel supply chute 34. Preferably, the fuel supplied to reactor 12 is coal, which is supplied with a sorbent material. Alternatively, a sorbent can be fed separately from the coal to capture sulfur and chlorine. However, fuels such as natural gas and fuel oil are acceptable. The choice of fuel depends upon the fuel economics and the BTU content and type of the waste to be incinerated. The fuel must be capable of providing enough heat input to maintain a minimum required incineration temperature.

In accordance with the present invention, the incineration apparatus includes means for feeding waste materials to be incinerated into the first chamber of the fluidized bed. The fine waste materials are initially incinerated in the first chamber and subsequently circulated over the partition to the second chamber wherein further incineration occurs. As embodied herein, waste materials are fed through primary waste supply chute 26 disposed in reactor 12. Preferably, the waste materials fed through waste supply chute 26 have been previously comminuted to a size of less than 2 inches. As shown in FIG. 1, waste supply chute 26 is positioned below fuel supply chute 34 and above the fluidized bed in reactor 12. Alternatively, the waste material may be fed directly into the fluidized bed.

Fine waste materials entering first chamber 16 are partially incinerated therein. Eventually, the fine waste materials will be transported by the fluidized bed over partition 20 for further incineration. The height of partition 20 should be sufficient to prevent large waste particles from being transported into second chamber 18. However, partition 20 should not be so high that it prevents fine waste particle exchange from first chamber 16 to second chamber 18. This fine waste particle exchange is important for maintaining an even incineration temperature throughout combustion apparatus 10.

Coarse waste materials entering first chamber 16 which are too heavy to be fluidized will drop by gravity through openings 22 provided in the bottom of the chamber. While dropping through the fluidized bed, the coarse particles will become partially dried out. Partial disinfection of the coarse waste occur while it is dropping through the fluidized bed. Openings 22 should be sized large enough to allow the coarse waste materials pass through without clogging the openings.

In accordance with the present invention, the incineration apparatus includes means for removing coarse waste materials from the first chamber. As embodied herein, a hopper 28 is disposed under first chamber 16 to remove coarse materials from the first chamber 16. Coarse materials are discharged by gravity from hopper 28 through valve 30 to crusher 32 which comminutes coarse particles to a desired size. The high temperature of waste materials entering crusher 32 may over a period of time destroy the internal components. Therefore, it may be necessary to transport the waste materials through a cooling device (not shown) prior to entering crusher 32.

In accordance with the present invention, the incineration apparatus includes means for recirculating the comminuted waste material to the second chamber for further incineration. As embodied herein, pneumatic blower 36 is disposed under crusher 32 to convey the comminuted waste material through pneumatic line 37 to secondary waste supply chute 39 for introduction into second chamber 18. Air back flow into crusher 32 is prevented by rotary valve 38.

In accordance with the present invention, the incineration apparatus includes means for removing materials from the bottom of the second chamber. As embodied herein, hopper 40 is disposed under second chamber 18. Partially incinerated waste materials and ash will drop by gravity through openings 22 from second chamber 18 and accumulate in hopper 40. The materials are then conveyed by gravity through valve 42 onto vibrating conveyer 44, which includes a screen (not shown). The partition 20 should be of a height sufficient to prevent particles having a size smaller than the screen of the vibrating conveyor from being immediately transferred to the second chamber. In a preferred embodiment, the materials conveyed onto vibrating conveyer 44 are separated by the screen into fine and coarse portions. The fine portion is fed into pneumatic line 46 via rotary valve 48. Air supplied from pneumatic blower 50 conveys the fine portion through pneumatic line 46 to a tertiary waste supply chute 52 for reintroduction into second chamber 18. Pneumatic line 46 includes valve 43 that remains in an open condition during the incineration process.

The coarse portion of the materials conveyed onto vibrating conveyer 44 is dropped by gravity onto belt conveyer 54 which transports the coarse portion to crusher 32. Once the comminuted materials exit crusher 32, they are transported by blower 36 through pneumatic line 37 to secondary feed chute 39.

Preferably, incineration apparatus 10 includes means for disposing of ash accumulating in second chamber 18. With reference to FIG. 1, ash is removed from second chamber 18 through second hopper 40. The ash exiting second hopper 40 drops through valve 42 onto conveyer 44. In one embodiment, valve 60 can be opened to dispose of ash conveyed from hopper 18. In another embodiment, the ash can be dropped into pneumatic line 46 via rotary valve 48 and blower 50 will convey the ash out of the apparatus through valve 62. In such a case, normally open valve 43 is closed to direct the ash downward through disposal valve 62.

The method and apparatus of the present invention allow infectious waste to be recirculated through the high temperature fluidized bed as many times as is required to completely disinfect and incinerate the waste. Such an apparatus provides an extremely reliable method of waste disposal. A minimum temperature of 300° F. is required to disinfect infectious waste. Fluidized bed reactor 12 is designed to be operated in the temperature range of 1400° F.–1800° F. The temperature is controlled by varying the fuel rate and the waste rate. Also, an external fluidized bed heat exchanger (not shown) may be utilized to maintain the desired temperature.

It will be apparent to those skilled in the art that modifications and variations can be made in the combustion apparatus and method of the present invention. The invention in its broader aspect is, therefore, not limited to the specific details, representative apparatus, and illustrative examples shown and described above. Thus it is intended that all matter contained in the foregoing description and shown in the accompanying drawing shall be interpreted as illustrative and not in a limiting sense.

What is claimed is:

1. A method of incinerating hazardous waste, comprising:

providing a fluidized bed reactor containing a bed of granular material, the reactor including a first chamber and a second chamber separated by a partition;

supplying a stream of pressurized air to the reactor at a sufficient velocity to fluidize the granular material in both the first and second chambers;

feeding waste material to be incinerated into the first chamber of the fluidized bed reactor, the fine waste materials being initially incinerated in the first chamber and subsequently circulated over the partition to the second chamber wherein further incineration occurs;

removing coarse waste materials from the first chamber;

comminuting the coarse waste materials removed from the first chamber;

circulating said comminuted waste material to the second chamber for further incineration; and removing materials from the bottom of the second chamber and recirculating said removed materials to the second chamber for further incineration.

2. The method of claim 1, wherein the stream of pressurized air supplied to the reactor creates a bubbling fluidized bed.

3. The method of claim 1, wherein the stream of pressurized air supplied to the reactor creates a circulating fluidized bed.

4. The method of claim 1, wherein the waste material fed to the reactor has been comminuted to a size of less than two inches.

5. The method of claim 1, wherein the materials removed from the bottom of the second chamber are separated into fine and coarse portions, the fine portion being conveyed to the second chamber for incineration and the coarse portion being first comminuted and then conveyed to the second chamber for incineration.

6. An apparatus for incinerating hazardous waste, comprising:

a fluidized bed reactor containing a bed of granular material, the reactor including a first chamber, a second chamber, and a vertical partition separating said first and second chambers, said reactor further including a plurality of openings;

means for supplying a pressurized stream of air to the reactor at a sufficient velocity to fluidize the granular material in both the first and second chambers;

means for supplying fuel to the reactor;

means for feeding waste materials to be incinerated into the first chamber of the fluidized bed, the fine waste materials being initially incinerated in the first chamber and subsequently circulated over the partition to the second chamber wherein further incineration occurs;

means for removing coarse waste materials from the first chamber;

means for comminuting the coarse waste materials removed from the first chamber;

means for recirculating the comminuted waste material to the second chamber for further incineration;

means for removing materials from the bottom of the second chamber; and means for recirculating the materials removed from the second chamber back to the second chamber for further incineration.

7. The apparatus of claim 6, wherein the means for removing the coarse waste material from the first chamber includes a first hopper disposed under the first chamber, said first shopper having a valve at other exit to control the flow of waste therefrom.

8. The apparatus of claim 7, wherein the means for comminuting the waste materials includes a crusher and the means for circulating the comminuted waste includes a pneumatic blower.

9. The apparatus of claim 8, wherein the means for removing materials from the second chamber includes a second hopper disposed underneath the second chamber and a conveyer disposed under said second hopper.

10. The apparatus of claim 9, further comprising means for separating the materials removed from the second chamber into fine and coarse portions, with the coarse portion being circulated to a crusher before being recirculated to the second chamber.

11. The apparatus of claim 6, wherein the fluidized bed reactor is maintained at a temperature in the range of about 1400° F. to about 1800° F.

12. The apparatus of claim 6, further comprising a means for disposing of ash accumulating in the second chamber.

13. The apparatus of claim 6, wherein the fuel supply means includes a fuel supply chute and the waste material supply means includes a waste supply chute, the fuel supply chute being positioned above the waste supply chute.

* * * * *

UNITED STATES PATENT AND TRADEMARK OFFICE

CERTIFICATE OF CORRECTION

PATENT NO. : 4,974,531

DATED : December 4, 1990

INVENTOR(S) : KORENBERG

It is certified that error appears in the above-identified patent and that said Letters Patent is hereby corrected as shown below:

Claim 7, column 6, line 56, change "shopper" to --hopper--.

Claim 7, column 6, line 56, change "other" to --the--.

Signed and Sealed this

Twenty-first Day of April, 1992

*Attest:*

HARRY F. MANBECK, JR.

*Attesting Officer*

*Commissioner of Patents and Trademarks*